US012391464B1

(12) United States Patent
Widick et al.

(10) Patent No.: US 12,391,464 B1
(45) Date of Patent: Aug. 19, 2025

(54) CONVERTIBLE, COLLAPSIBLE AND REUSABLE SHIPPING CRATE

(71) Applicants: Michael Widick, Oxford, AL (US); Clyde Edwards, Anniston, AL (US); David Owens, Rome, GA (US)

(72) Inventors: Michael Widick, Oxford, AL (US); Clyde Edwards, Anniston, AL (US); David Owens, Rome, GA (US)

(73) Assignee: Wright Metal Products Crates, LLC, Rome, GA (US)

( * ) Notice: Subject to any disclaimer, the term of this patent is extended or adjusted under 35 U.S.C. 154(b) by 0 days.

(21) Appl. No.: 17/585,687

(22) Filed: Jan. 27, 2022

(51) Int. Cl.

| | |
|---|---|
| ***B65D 85/68*** | (2006.01) |
| ***B65D 85/64*** | (2006.01) |
| ***B65D 88/00*** | (2006.01) |
| ***B65D 88/52*** | (2006.01) |

(52) U.S. Cl.
CPC ..... *B65D 85/68* (2013.01); *B65D 85/64* (2013.01); *B65D 88/005* (2013.01); *B65D 88/522* (2013.01); *B65D 2585/649* (2013.01); *B65D 2585/686* (2013.01); *B65D 2588/12* (2013.01); *B65D 2590/005* (2013.01); *B65D 2590/54* (2013.01)

(58) Field of Classification Search
CPC ... B60P 3/07; B60P 3/08; B65D 85/64; B65D 85/68; B65D 88/005; B65D 88/022; B65D 88/121; B65D 88/123; B65D 2585/649; B65D 2585/686; B65D 2588/12; B65D 2590/005; B65D 2590/54; B65D 88/522
USPC ..... 206/335; 220/6, 7
See application file for complete search history.

(56) References Cited

U.S. PATENT DOCUMENTS

| | | | | |
|---|---|---|---|---|
| 4,768,916 | A * | 9/1988 | Gearin | B61D 3/18 410/16 |
| 5,445,278 | A * | 8/1995 | Gearin | B65D 88/022 410/16 |
| 6,655,300 | B1 * | 12/2003 | Clive-Smith | B60P 3/08 108/55.1 |
| 7,011,479 | B2 * | 3/2006 | Sain | B65D 88/005 410/77 |
| 7,021,461 | B1 * | 4/2006 | Robey | B65D 85/68 206/335 |

* cited by examiner

*Primary Examiner* — Bryon P Gehman
(74) *Attorney, Agent, or Firm* — John R. Perkins, Jr.; Perkins Law Firm

(57) ABSTRACT

The present invention generally relates to a convertible, collapsible and reusable shipping crate. The crate is convertible in that the same base can used with extendable gates or fixed gates to ship equipment of differing heights, lengths, and wheel bases. At least one end of the crate may operate as a gate on a hinge for the loading and unloading of motorized vehicles. The hinge is comprised of a slotted plate on each side to lock the gates into place for loading and to raise the gates upright once loading is completed. The slotted plate positions the gates in an upright, locked position to carry all the weight on the upright beams of the gate, rather than the hinges, thereby allowing multiple crates to be stacked. The slotted plates also allow each of the two gates to collapse inward and flat on the base for stacking during return. The gates, optional cross braces, and slotted plates all contain removable pins as connectors so that no hand tools are required for setup, operation, and breakdown of the crate. The crate is reusable many times.

26 Claims, 7 Drawing Sheets

CONVERTIBLE, COLLAPSIBLE AND REUSABLE SHIPPING CRATE

FIELD OF THE INVENTION

The present invention generally relates to reusable shipping crate and, more particularly, to a convertible, collapsible and reusable shipping crate for use with shipping motorized vehicles.

BACKGROUND OF THE INVENTION

Most motorized vehicles are shipped using wood crates that are simply discarded after use. Metal crates are ironically a greener solution because they can be reused many times. Returning these metal crates is, however, very expensive.

Metal crates are also difficult to adjust for a variety of differently sized vehicles and, therefore, generally prevent use for more than one purpose. Adjustable crates could resolve this deficiency in the prior art.

Metal crates generally require the use of tools to assemble, open, close, stack, and breakdown. A crate that would allow a user to assemble, use, and breakdown without the use of hand tools would be beneficial.

Prior art metal crates do not contain hinges that would allow one side of the crate to operate as a loading gate. A metal crate that would open one side as a gate with a heavy-duty hinge would be beneficial. Hinges are generally not heavy duty, however. If the hinge can be made so as to transfer the vertical load to the vertical frame members, that would be beneficial and allow stacking of multiple crates.

What is needed is a metal crate that can be reused multiple times. While wood crates might seem to be a cheaper and greener solution than metal crates, the opposite is true.

Metal crates may be used multiple times, often with nothing more than minor repairs, making them far cheaper and greener over their lifespan.

What is needed is a metal crate that can be adjusted for use with many different types and sizes of motorized vehicles. Generally metal crates avoid adjustability because adjustable portions are often too weak to support the heavy use for shipping heavy motorized vehicles. What's worse is trying to stack metal crates with adjustable portions. A metal crate that can be easily adjusted would be beneficial to a manufacturer shipping multiple types and sizes of vehicles.

What is needed is a metal crate that can be assembled, used, adjusted, and broken down for return without the need for hand tools. Crates that require hand tools generally take far longer to setup and use. Tools may or may not be available in any event.

What is needed is a metal crate that can be broken down easily and stored in a smaller vertical height for return shipping. Most metal crates cannot be folded or otherwise shipped in any state other than fully assembled or fully disassembled with many loose parts. A metal crate with little to no loose parts that can fold onto itself to allow for space efficient stacking would be beneficial.

An object of the present invention is to provide a metal shipping crate that may be reused multiple times to avoid the use of wood, which is not generally reusable for shipping crates.

An object of the present invention is to provide a metal shipping crate that is adjustable so as to allow users to ship multiple sizes, shapes, and types of cargo.

An object of the present invention is to provide a metal shipping crate that may be assembled, setup, used, adjusted, and broken down without the need for hand tools.

An object of the present invention is to provide a metal shipping crate that may be folded while assembled to minimize storage space when not in use and when stacked for return to the manufacturer for reuse.

SUMMARY OF THE INVENTION

The present invention accomplishes the foregoing object by providing a collapsible, convertible and reusable shipping crate that may be reused multiple times to avoid the use of wood, plastic or other materials, which are not generally reusable for shipping crates.

The present invention accomplishes the foregoing object by providing a collapsible, convertible and reusable shipping crate that is adjustable so as to allow users to ship multiple sizes, shapes, and types of cargo.

The present invention accomplishes the foregoing object by providing a collapsible, convertible and reusable shipping crate that may be assembled, setup, used, adjusted, and broken down for return without the need for hand tools.

The present invention accomplishes the foregoing object by providing a collapsible, convertible and reusable shipping crate that may be folded while assembled to minimize storage space when not in use and when stacked for return to the manufacturer for reuse.

The present invention provides a collapsible, convertible and reusable shipping crate, comprising: three rectangular frames comprised of a multiplicity of perpendicularly connected members bound together, wherein each of said three rectangular frames are fastened together perpendicularly to form an enclosure comprising a base, first gate and second gate; wherein said first gate and said second gate are connected to opposing ends of said base by a hinged connector that allows each of said first gate and second gate to pivot from substantially parallel to substantially perpendicular to said base; wherein said hinged connector comprises a slotted locking plate disposed upon each of its distal ends, said slotted locking plate configured to allow one of said first gate and said second gate to lock into place when pivoted to the substantially parallel position and when pivoted to the substantially perpendicular position, so that any weight placed upon the opposite end of said first gate and said second gate will be transferred to said base through at least two of said multiplicity of perpendicularly connected members within one of said first gate and said second gate; and a multiplicity of connectors to connect said base, first gate and second gate, without the use of hand tools.

In another aspect of the invention, the reusable, collapsible shipping crate may optionally be configured wherein said base, first gate, and second gate may each pivot so that said base, first gate, and second gate may be folded into a parallel stack without the use of hand tools.

In another aspect of the invention, the reusable, collapsible shipping crate may optionally be configured to contain a side brace for diagonally connecting one of said three rectangular frames to another of said three rectangular frames.

In another aspect of the invention, the reusable, collapsible shipping crate may optionally be configured wherein the hinged connector is of sufficient strength to allow the loading of a motorized vehicle while one of said first gate and second gate are pivoted to a position substantially parallel to said base.

In another aspect of the invention, the reusable, collapsible shipping crate may optionally be configured wherein said multiplicity of perpendicularly connected members bound together are of sufficient strength so to support the weight of one or more additional collapsible shipping crates stacked thereon.

In another aspect of the invention, the reusable, collapsible shipping crate may optionally be configured wherein said multiplicity of perpendicularly connected members bound together contain a multiplicity of connection holes so as to allow adjustment of the lengths of the various multiplicity of perpendicularly connected members bound together.

In another aspect of the invention, the reusable, collapsible shipping crate may optionally be configured wherein said multiplicity of perpendicularly connected members bound together that comprise said first gate are extendable so as to lengthen said first gate.

In another aspect of the invention, the reusable, collapsible shipping crate may optionally be configured wherein said multiplicity of perpendicularly connected members bound together that comprise said second gate are extendable so as to lengthen said second gate.

In yet another aspect of the invention, a method is provided to use a collapsible, convertible and reusable shipping crate comprising: three rectangular frames comprised of a multiplicity of perpendicularly connected members bound together, wherein each of said three rectangular frames are fastened together perpendicularly to form an enclosure comprising a base, first gate and second gate; wherein said first gate and said second gate are connected to opposing ends of said base by a hinged connector that allows each of said first gate and second gate to pivot from substantially parallel to substantially perpendicular to said base; wherein said hinged connector comprises a slotted locking plate disposed upon each of its distal ends, said slotted locking plate configured to allow one of said first gate and said second gate to lock into place when pivoted to the substantially parallel position and when pivoted to the substantially perpendicular position, so that any weight placed upon the opposite end of said first gate and said second gate will be transferred to said base through at least two of said multiplicity of perpendicularly connected members within one of said first gate and said second gate; and a multiplicity of connectors to connect said base, first gate and second gate, without the use of hand tools.

The method is optionally performed wherein said base, first gate, and second gate may each pivot so that said base, first gate, and second gate may be folded into a parallel stack without the use of hand tools.

The method is also optionally performed wherein said collapsible, reusable shipping crate further comprises a side brace for diagonally connecting one of said three rectangular frames to another of said three rectangular frames.

The method is also optionally performed wherein said hinged connector is of sufficient strength to allow the loading of a motorized vehicle while one of said first gate and second gate are pivoted to a position substantially parallel to said base.

The method is also optionally performed wherein said multiplicity of perpendicularly connected members bound together are of sufficient strength so to support the weight of one or more additional collapsible, reusable shipping crates stacked thereon.

The method is also optionally performed wherein said multiplicity of perpendicularly connected members bound together contain a multiplicity of connection holes so as to allow adjustment of the lengths of the various multiplicity of perpendicularly connected members bound together.

The method is also optionally performed wherein said multiplicity of perpendicularly connected members bound together that comprise said first gate are extendable so as to lengthen said first gate.

The method is also optionally performed wherein said multiplicity of perpendicularly connected members bound together that comprise said first gate are extendable so as to lengthen said second gate.

The method is also optionally performed wherein said multiplicity of perpendicularly connected members bound together that comprise said first gate and said second gate are fixed-length.

The method is also optionally performed wherein said multiplicity of perpendicularly connected members bound together that comprise said base further comprise an adjustable wheel chock for shipping motorized vehicles with a multiplicity of wheel base sizes.

DESCRIPTION OF THE DRAWINGS

The invention will be more readily understood with reference to the following specification in conjunction with the drawings herein:

FIG. 5A is a side view of a three stacked convertible, collapsible and reusable shipping crates according to a preferred embodiment of the invention.

FIG. 5B is a side view of a chain locking mechanism used for stacking convertible, collapsible and reusable shipping crates according to a preferred embodiment of the invention.

DESCRIPTION OF THE PREFERRED EMBODIMENTS

Figure 1:
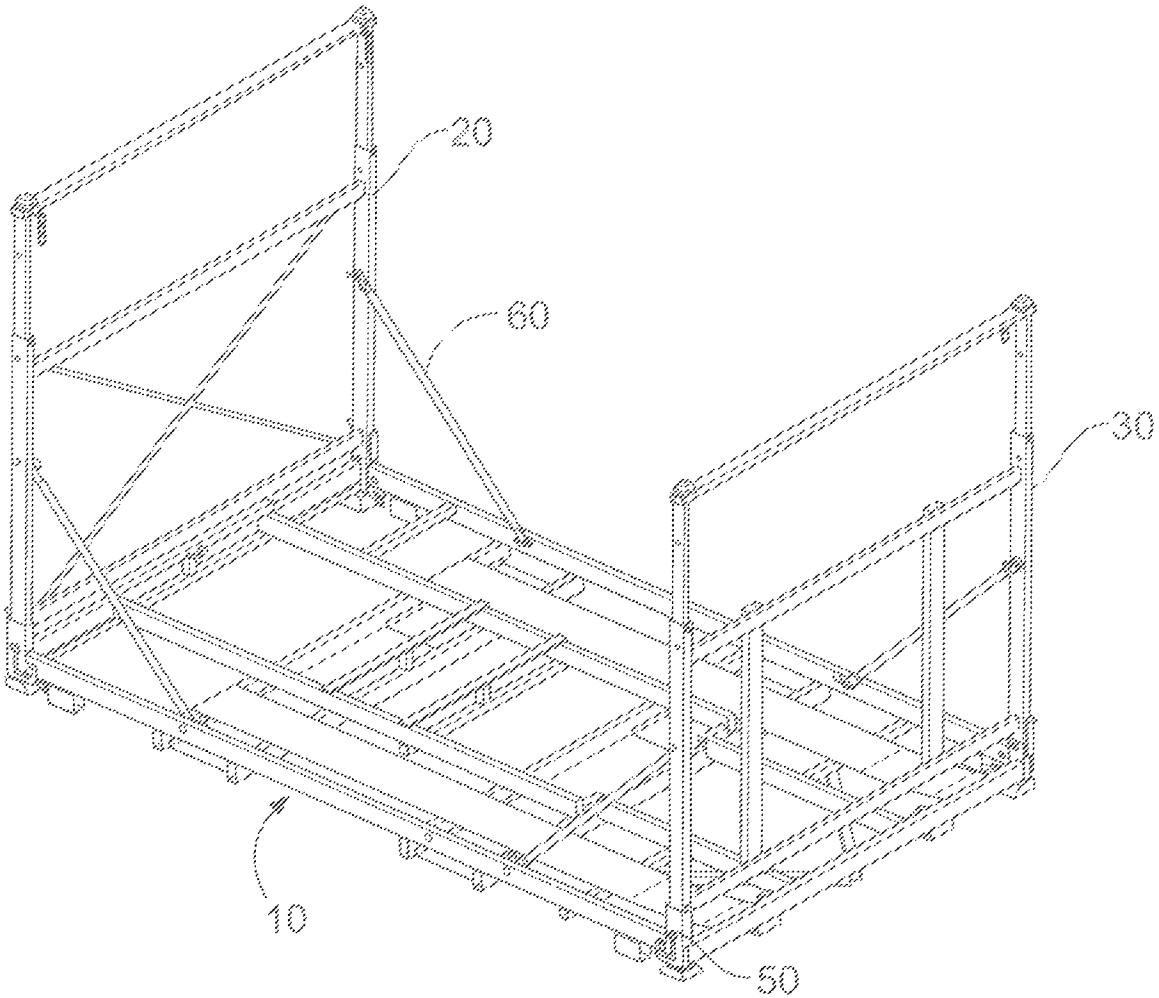
FIG. 1 is a diagonal view of a convertible, collapsible and reusable shipping crate according to a preferred embodiment of the invention.

Referring now to FIG. 1, a convertible, collapsible and reusable shipping crate 100 is illustrated according to a preferred embodiment of the invention. Three rectangular frames comprised of a multiplicity of perpendicularly connected members are bound together to form an enclosure comprising a base 10, first gate 20 and second gate 30. The multiplicity of perpendicularly connected members are preferably comprised of metal tubing as illustrated in FIG. 1. Each of first gate 20 and second gate 30 are connected on opposing ends to base 10 with a heavy-duty hinge that allows first gate 20 and second gate 30 to pivot from a substantially perpendicular position to substantially parallel position to base 10 in two directions. In this manner, first gate 10 and second gate 20 may be raised or lowered to load a motorized vehicle for shipment, and later folded inward for return shipping. The hinge is comprised of two slotted locking plates 50 affixed to each distal end of first gate 20 and second gate 30.

One or more diagonal braces 60 may be used to further stiffen the enclosure in the upright position. Because the invention is designed for assembly and breakdown without the use of hand tools, diagonal braces 60 would be preferably connected with a standard locking pin on each distal end, rather than nuts and bolts.

Figure 2A:
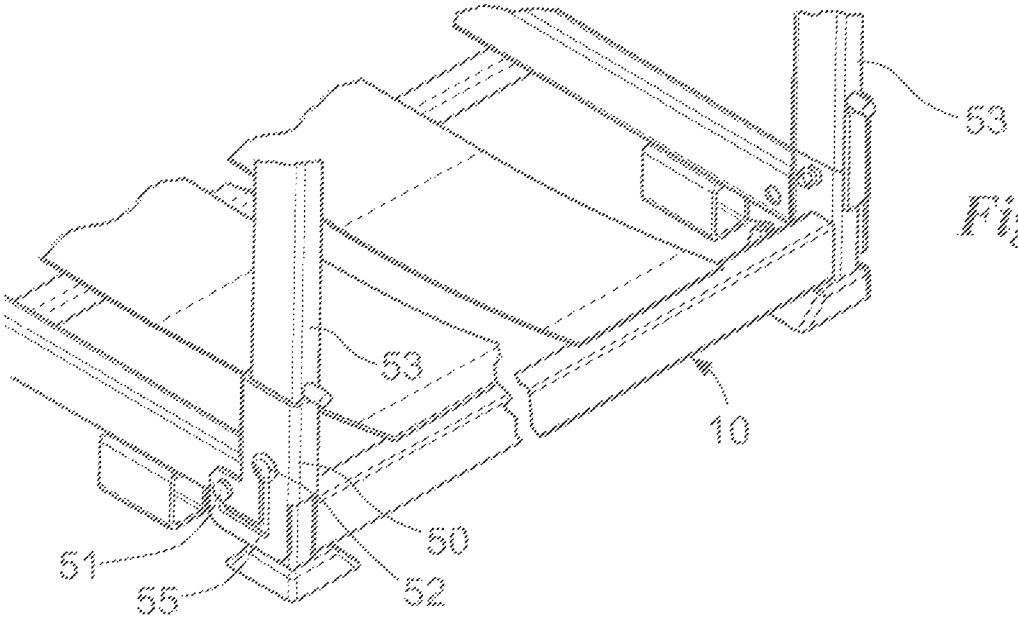
FIG. 2A is a diagonal view of a pivoting gate used in a convertible, collapsible and reusable shipping crate according to a preferred embodiment of the invention, where the pivoting gate is in the upright position.

Referring now to FIG. 2A, slotted locking plate 50 is illustrated in more detail according to a preferred embodiment of the invention. Pins 51 and 52 are affixed to hold slotted locking plate 50 in place on each end of a first and second gate. Pin 51 is removable so that slotted locking plate 50 may pivot on pin 52. By contrast, pin 52 is not designed to be easily removable. Pin 52 is preferably a bolt with a locknut that cannot be removed without hand tools. The same configuration for slotted locking plate 50, pin 51 and pin 52 is preferably used on the opposite gate also, where for example first gate 20 from FIG. 1 uses a mirrored version of the same configuration as second gate 30.

Figure 2B:
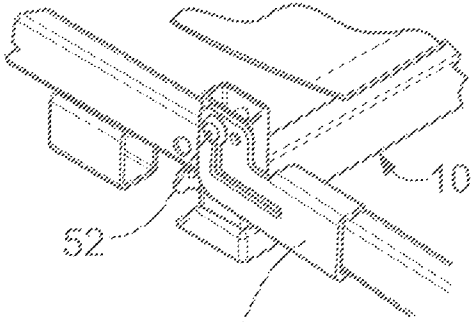
FIG. 2B is a diagonal view of a pivoting gate used in a convertible, collapsible and reusable shipping crate according to a preferred embodiment of the invention, where the pivoting gate is in the loading position.
Figure 2C:
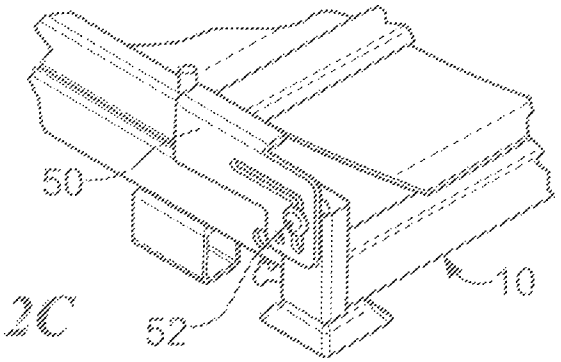
FIG. 2C is a diagonal view of a pivoting gate used in a convertible, collapsible and reusable shipping crate according to a preferred embodiment of the invention, where the pivoting gate is in the return shipping position.

As shown in FIGS. 2A, 2B, and 2C, these pins operate within L-shaped groove 55 to allow the gate to be raised and lowered for the loading and unloading of motorized vehicles and to fold the gate flat for return shipping. Importantly, when the gate is in the raised position, slotted locking plate 50 allows the upright members 53 on each end of the gate to transfer all of the load from the upper portions of upright members 53 to the base 10, rather than to pins 51 and 52. In this manner, multiple shipping crates 100 can be safely stacked for shipping, where all of the load is carried by the multiplicity of perpendicularly connected members bound together to form base 10, first gate 20, and second gate 30, rather than pins 51 and 52.

FIG. 2B illustrates slotted locking plate 50 in the lowered position for loading motorized vehicles. Pin 51 has been removed and the gate has been lowered to the loading position by pivoting slotted locking plate 50 on pin 52.

FIG. 2C illustrates slotted locking plate 50 in the return shipping position. Again, pin 51 has been removed and now the gate has been folded inward to lie parallel on top of base 10, by pivoting the gate on pin 52. In this manner, both first gate 20 second gate 30 may be folded inward onto base 10 to reduce the overall size of shipping crate 100 for return shipping after the motorized vehicle is removed.

Figure 3A:
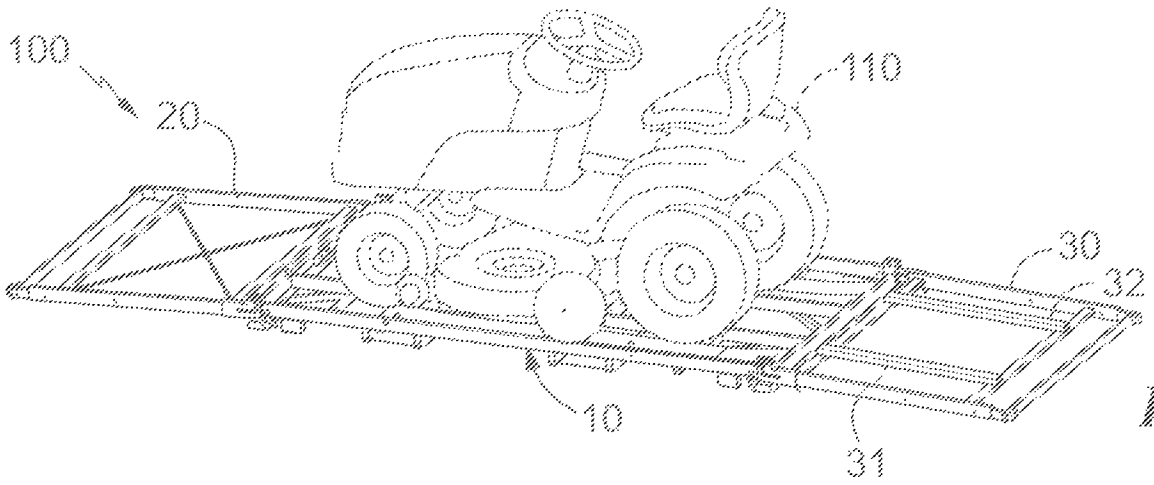
FIG. 3A is a diagonal view of a convertible, collapsible and reusable shipping crate according to a preferred embodiment of the invention, where the pivoting gates are in the loading position.
Figure 3C:
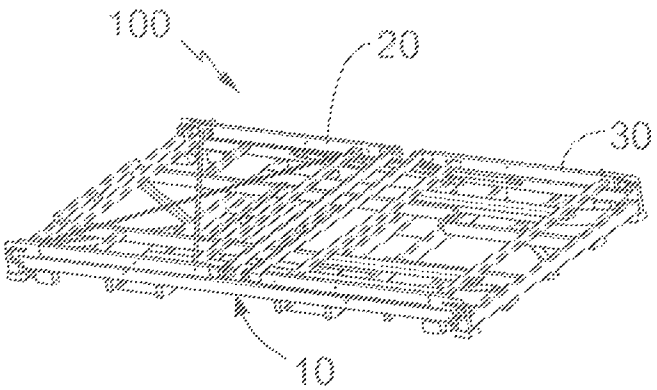
FIG. 3C is a diagonal view of a convertible, collapsible and reusable shipping crate according to a preferred embodiment of the invention, where the pivoting gates are in the folded return shipping position.
Figure 3B:
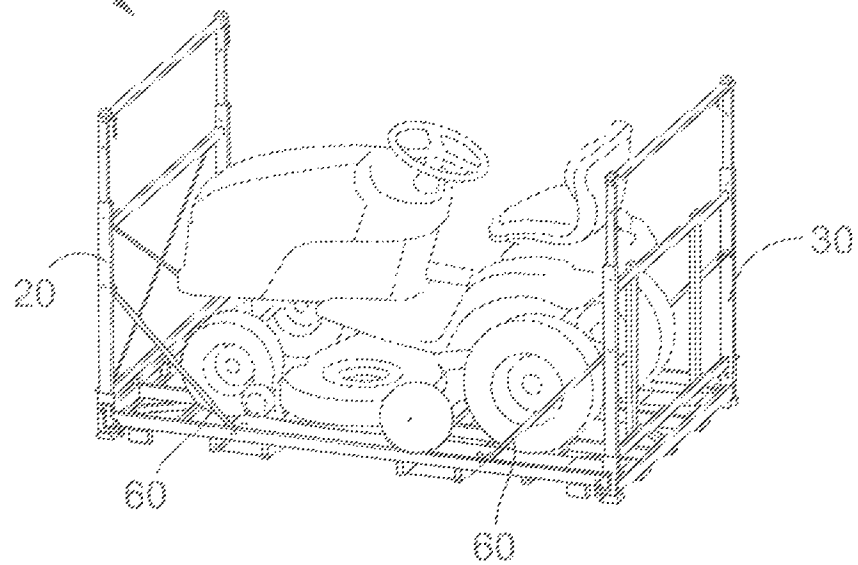
FIG. 3B is a diagonal view of a convertible, collapsible and reusable shipping crate according to a preferred embodiment of the invention, where the pivoting gates are in the upright shipping position.

Operation of slotted locking plate 50 is further illustrated in FIGS. 3A, 3B, and 3C. FIG. 3A shows first gate 20 and second gate 30 in the lowered position for the loading or unloading of motorized vehicle 110, in this case a riding lawn mower. At least two of the multiplicity of perpendicularly connected members bound together to form second gate 30, illustrated here as members 31 and 32, may be used to create a loading ramp when second gate 30 is lowered as shown.

FIG. 3B indicates first gate 20 and second gate 30 in the raised and locked position for the shipment of the motorized vehicle. Diagonal braces 60 are now affixed to fasten first gate 20 and second gate 30 to base 10 for additional strength. Each diagonal brace 60 consists of a length of rigid material, preferably metal, with a pin hole in each distal end. Rather than nuts, bolts, screws and the like, removable pins are inserted into each of these pin holes and then through holes in the matching locations on each of first gate 20, second gate 30, and base 10, as shown. In this manner, no hand tools are required to load and unload a motorized vehicle for shipment. Moreover and preferably, no hand tools are required for any setup, use, or return shipment of shipping crate 100.

When motorized vehicle 110 has been removed from shipping crate 100 after shipping, as shown in FIG. 3C, shipping crate 100 may then be folded into a smaller footprint for return shipping. The removable pins used to connect one or more diagonal braces 60, if used, are removed. Pin 51, not illustrated here, may then be removed. First gate 20 and second gate 30 are then pivoted on pins 52 and folded into a parallel position on top of base 10 as shown. In this manner, shipping crate 100 is collapsible. A multitude of shipping crates 100 may be stacked into a single load for return shipping to reduce shipping costs. In this manner, shipping crate 100 is reusable many times.

Figure 4:
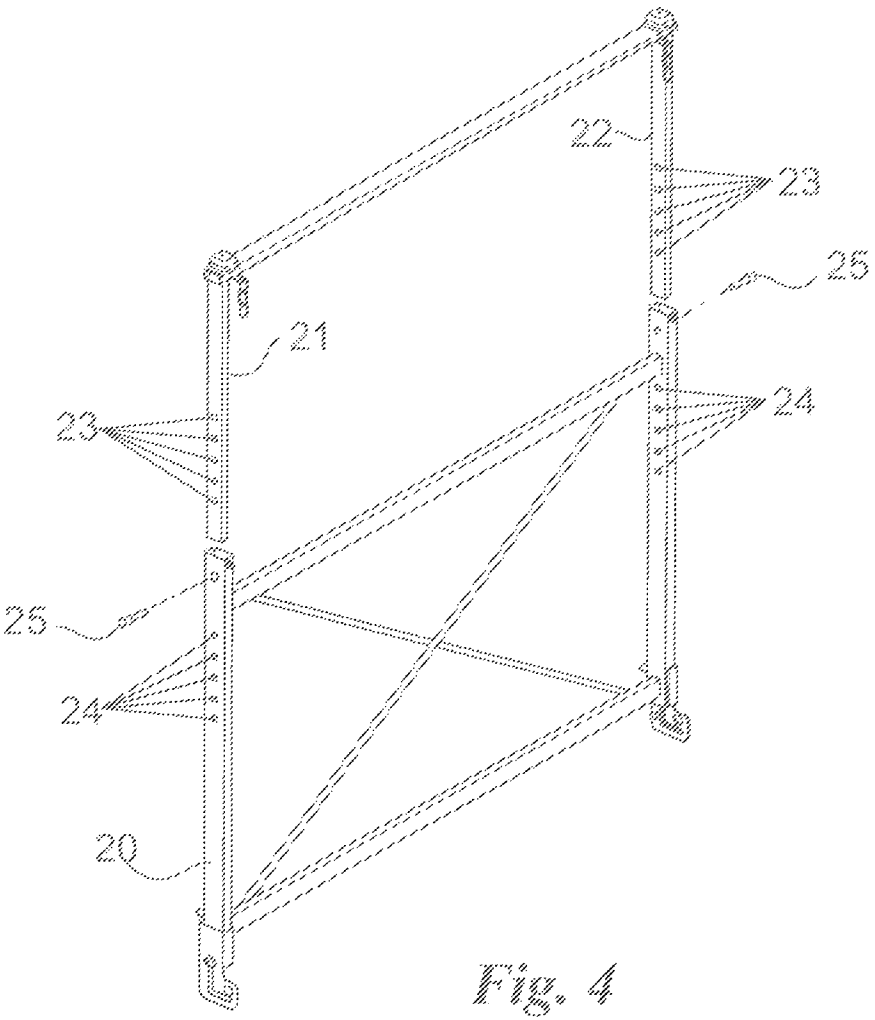
FIG. 4 is a diagonal view of an adjustable gate used in a convertible, collapsible and reusable shipping crate according to a preferred embodiment of the invention.
Figure 53:
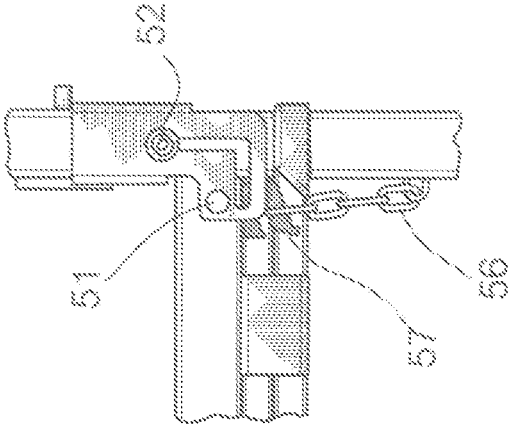
Figure 54:
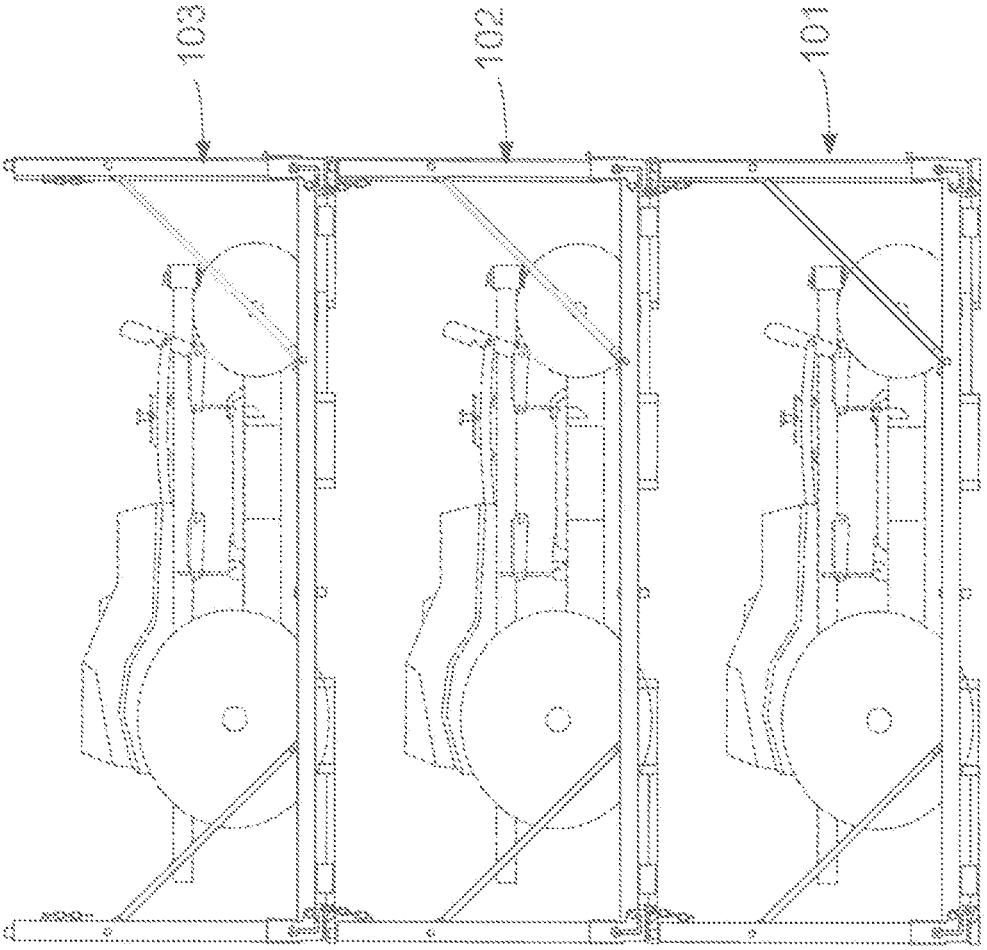

A preferred embodiment of the shipping crate of the present invention is also adjustable for use with a variable sized payload. As shown in FIG. 4, at least two of the multiplicity of perpendicularly connected members bound together to form first gate 20, for example, may be extendable as with extendable members 21 and 22 in the upper portion of first gate 20. A series of holes 23 are present in extendable members 21 and 22, that match with a series of holes 24 in the lower portion of first gate 20. Extendable members 21 and 22 insert into the slightly larger members in the lower portion of first gate 20 as shown. Once the desired length of first gate 20 is reached, two or more removable locking pins 25 are inserted into the matching points through holes 23 and 24 to lock extendable members 21 and 22 into place.

Shipping crate 100 may also be stacked for shipping multiple motorized vehicles in a single shipment as shown in FIG. 5A, where three zero-turn-mowers (ZTR) are stacked in three shipping crates 101, 102, and 103, according to a preferred embodiment of the invention. FIG. 5B illustrates a preferred means of binding each of the three shipping crates together when stacked using chain 56 and hook 57. In a preferred embodiment of the invention, each shipping crate has a hook 57 on the lower portion of each base, along with a chain 56 on the upper portion of gates 20 and 30. When stacked and pin 51 is inserted as shown, chain 56 on crate 101 may be fastened to hook 57 on crate 102, on each of the four corners. The same may be done to fasten crate 102 to crate 103.

In some cases, an entirely different type of motorized vehicle or other cargo may need to be shipped using shipping crate 100. If, for example a ZTR needs to be shipped, rather than a tractor-style riding mower, shipping crate 100 is also convertible. Prior art metal shipping crates are single-type-use only, meaning they can only be used to ship a single, specific type of motorized vehicle with a defined length, width and weight. One aspect of the present invention, however, is that base 10 is easily reconfigurable to accept a variety of different motorized vehicles.

Figure 6:
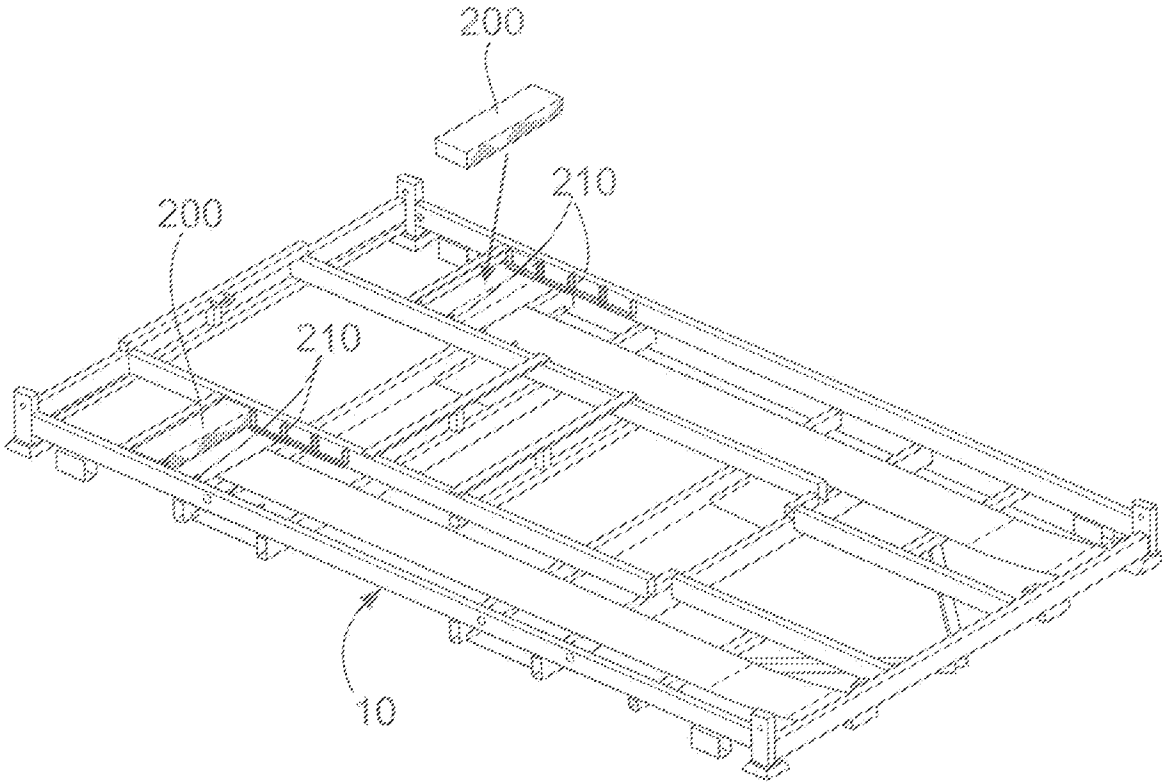
FIG. 6 is a diagonal view of a base used in a convertible, collapsible and reusable shipping crate according to a preferred embodiment of the invention.

In a preferred embodiment of the invention, shipping crate 100 is convertible as follows. As shown in FIG. 6, the tire chock location is adjustable using removable chocks 200, which fits into chock adjustment bases 210. The user may simply remove chocks 200 and place them into a different slots within adjustment bases 210 as illustrated to allow for a shorter or longer wheel base vehicle.

Figure 7A:
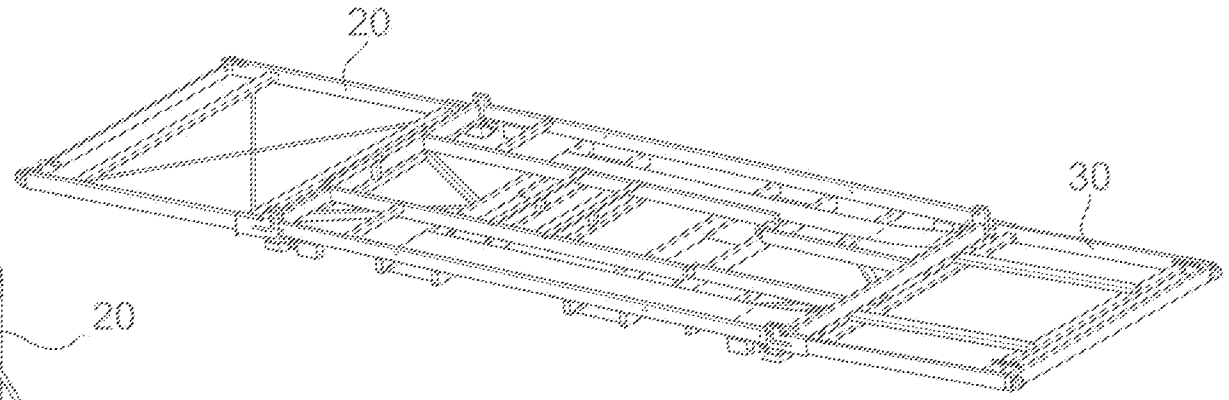
FIG. 7A is a diagonal view of a convertible, collapsible and reusable shipping crate according to a preferred embodiment of the invention, where the pivoting gates are in the loading position.
Figure 7B:
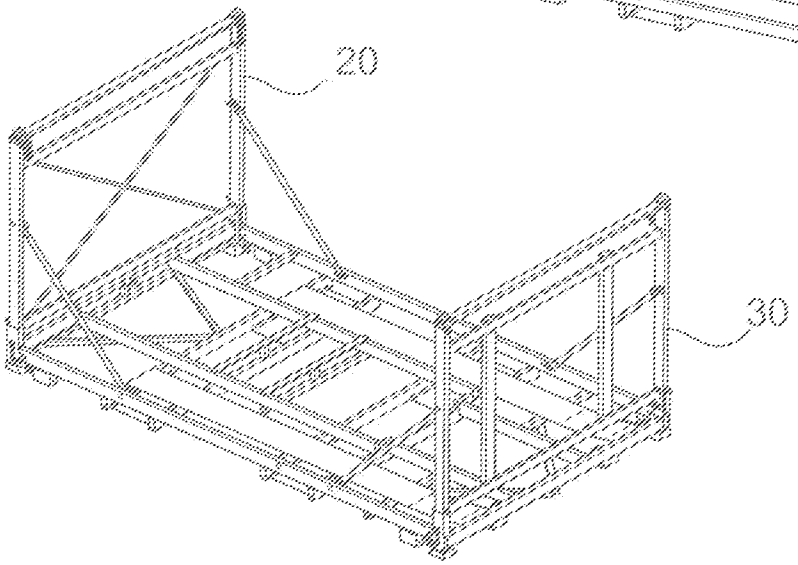
FIG. 7B is a diagonal view of a convertible, collapsible and reusable shipping crate according to a preferred embodiment of the invention, where the pivoting gates are in the upright shipping position.
Figure 7C:
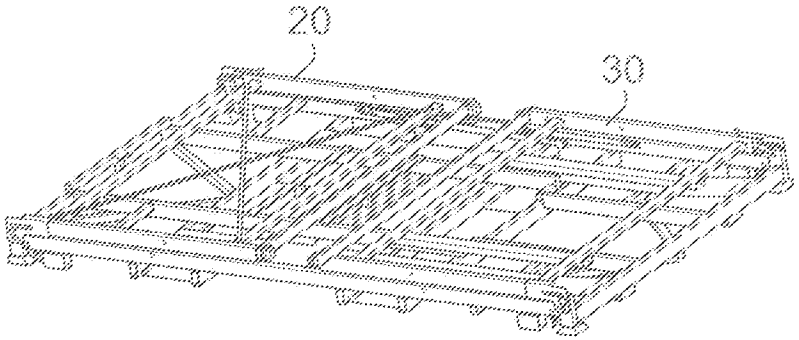
FIG. 7C is a diagonal view of a convertible, collapsible and reusable shipping crate according to a preferred embodiment of the invention, where the pivoting gates are in the folded return shipping position.

Because other motorized vehicles may also be shorter or longer, such as a ZTR compared to a tractor mower, first gate 20 and second gate 30 may be converted from adjustable as shown in FIG. 4, to fixed length as shown in FIGS. 7A, 7B, and 7C. This is often necessary so as to allow gates 20 and 30 to fold for return shipping as shown in FIG. 7C. This elimination of adjustability in this new converted configuration may also provide additional strength to shipping crate 100 as may be needed to ship heavier motorized vehicles.

The invention has been described with reference to the preferred embodiments without limit thereto. Additional embodiments and improvements may be realized which are not specifically set forth herein but which are within the scope of the invention as more specifically set forth in the claims appended hereto.

The invention claimed is:

1. A collapsible, convertible and reusable shipping crate, comprising:

three rectangular frames comprised of a multiplicity of connected members bound together, wherein said three rectangular frames are fastened together to form an enclosure comprising a base, first gate and second gate;

wherein said first gate and said second gate are connected to opposing ends of said base by a hinged connector that allows each of said first gate and second gate to pivot from substantially parallel to substantially perpendicular to said base;

wherein said hinged connector comprises a slotted locking plate configured to allow one of said first gate and said second gate to lock into place when pivoted to the substantially parallel position and when pivoted to the substantially perpendicular position, so that any weight placed upon said first gate and said second gate will be transferred to said base through at least two of said multiplicity of connected members within one of said first gate and said second gate;

a multiplicity of connectors to connect said base, first gate and second gate, without the use of hand tools.

2. The collapsible, reusable shipping crate of claim 1, wherein said base, first gate, and second gate may each pivot so that said base, first gate, and second gate may be folded into a parallel stack without the use of hand tools.

3. The collapsible, reusable shipping crate of claim 1, further comprising a side brace for diagonally connecting one of said three rectangular frames to another of said three rectangular frames.

4. The collapsible, reusable shipping crate of claim 1, wherein said hinged connector is of sufficient strength to allow the loading of a motorized vehicle while one of said first gate and second gate are pivoted to a position substantially parallel to said base.

5. The collapsible, reusable shipping crate of claim 1, wherein said multiplicity of perpendicularly connected members bound together are of sufficient strength so to support the weight of one or more additional collapsible, reusable shipping crates stacked thereon.

6. The collapsible, reusable shipping crate of claim 1, wherein said multiplicity of perpendicularly connected members bound together contain a multiplicity of connection holes so as to allow adjustment of the lengths of the various multiplicity of perpendicularly connected members bound together.

7. The collapsible, reusable shipping crate of claim 1, wherein said multiplicity of perpendicularly connected members bound together that comprise said first gate are extendable so as to lengthen said first gate.

8. The collapsible, reusable shipping crate of claim 1, wherein said multiplicity of perpendicularly connected members bound together that comprise said second gate are extendable so as to lengthen said second gate.

9. The collapsible, reusable shipping crate of claim 1, wherein said multiplicity of perpendicularly connected members bound together that comprise said first gate and said second gate are fixed-length.

10. The collapsible, reusable shipping crate of claim 1, wherein said multiplicity of perpendicularly connected members bound together that comprise said base further comprise an adjustable wheel chock for shipping motorized vehicles with a multiplicity of wheel base sizes.

11. A collapsible, convertible and reusable shipping crate, comprising:

three rectangular frames comprised of a multiplicity of connected members bound together, wherein each of said three rectangular frames are fastened together to form an enclosure comprising a base, first gate and second gate;

wherein said first gate and said second gate are connected to opposing ends of said base by a hinged connector that allows each of said first gate and second gate to pivot from substantially parallel to substantially perpendicular to said base;

wherein said multiplicity of connected members bound together that comprise said first gate are extendable so as to lengthen said first gate;

wherein said multiplicity of connected members bound together that comprise said second gate are extendable so as to lengthen said second gate;

wherein said hinged connector comprises a slotted locking plate configured to allow one of said first gate and said second gate to lock into place when pivoted to the substantially parallel position and when pivoted to the substantially perpendicular position, so that any weight placed upon said first gate and said second gate will be transferred to said base through at least two of said multiplicity of connected members within one of said first gate and said second gate;

a multiplicity of connectors to connect said base, first gate and second gate, without the use of hand tools.

12. The collapsible, reusable shipping crate of claim 11, wherein said base, first gate, and second gate may each pivot so that said base, first gate, and second gate may be folded into a parallel stack without the use of hand tools.

13. The collapsible, reusable shipping crate of claim 11, further comprising a side brace for diagonally connecting one of said three rectangular frames to another of said three rectangular frames.

14. The collapsible, reusable shipping crate of claim 11, wherein said hinged connector is of sufficient strength to allow the loading of a motorized vehicle while one of said first gate and second gate are pivoted to a position substantially parallel to said base.

15. The collapsible, reusable shipping crate of claim 11 wherein said multiplicity of perpendicularly connected members bound together are of sufficient strength so to support the weight of one or more additional collapsible, reusable shipping crates stacked thereon.

16. The collapsible, reusable shipping crate of claim 11, wherein said multiplicity of perpendicularly connected members bound together contain a multiplicity of connection holes so as to allow adjustment of the lengths of the various multiplicity of perpendicularly connected members bound together.

17. A method of using a collapsible, convertible and reusable shipping crate, comprising the steps of:

providing three rectangular frames comprised of a multiplicity of perpendicularly connected members bound together, wherein each of said three rectangular frames are fastened together to form an enclosure comprising a base, first gate and second gate;

wherein said first gate and said second gate are connected to opposing ends of said base by a hinged connector that allows each of said first gate and second gate to pivot from substantially parallel to substantially perpendicular to said base;

wherein said hinged connector comprises a slotted locking plate configured to allow one of said first gate and said second gate to lock into place when pivoted to the substantially parallel position and when pivoted to the substantially perpendicular position, so that any weight placed upon said first gate and said second gate will be transferred to said base through at least two of said multiplicity of connected members within one of said first gate and said second gate; and providing a multiplicity of connectors to connect said base, first gate and second gate, together without the use of hand tools.

18. The method of using a collapsible, convertible and reusable shipping crate, according to claim 17, wherein said base, first gate, and second gate may each pivot so that said base, first gate, and second gate may be folded into a parallel stack without the use of hand tools.

19. The method of using a collapsible, convertible and reusable shipping crate, according to claim 17, wherein said collapsible, reusable shipping crate further comprises a side brace for diagonally connecting one of said three rectangular frames to another of said three rectangular frames.

20. The method of using a collapsible, convertible and reusable shipping crate, according to claim 17, wherein said hinged connector is of sufficient strength to allow the loading of a motorized vehicle while one of said first gate and second gate are pivoted to a position substantially parallel to said base.

21. The method of using a collapsible, convertible and reusable shipping crate, according to claim 17, wherein said multiplicity of perpendicularly connected members bound together are of sufficient strength so to support the weight of one or more additional collapsible, reusable shipping crates stacked thereon.

22. The method of using a collapsible, convertible and reusable shipping crate, according to claim 17, wherein said multiplicity of perpendicularly connected members bound together contain a multiplicity of connection holes so as to allow adjustment of the lengths of the various multiplicity of perpendicularly connected members bound together.

23. The method of using a collapsible, convertible and reusable shipping crate, according to claim 17, wherein said multiplicity of perpendicularly connected members bound together that comprise said first gate are extendable so as to lengthen said first gate.

24. The method of using a collapsible, convertible and reusable shipping crate, according to claim 17, wherein said multiplicity of perpendicularly connected members bound together that comprise said second gate are extendable so as to lengthen said second gate.

25. The method of using a collapsible, convertible and reusable shipping crate, according to claim 17, wherein said multiplicity of perpendicularly connected members bound together that comprise said first gate and said second gate are fixed-length.

26. The method of using a collapsible, convertible and reusable shipping crate, according to claim 17, wherein said multiplicity of perpendicularly connected members bound together that comprise said base further comprise an adjustable wheel chock for shipping motorized vehicles with a multiplicity of wheel base sizes.

* * * * *